US006018635A

United States Patent [19]

Edura

[11] Patent Number: 6,018,635

[45] Date of Patent: Jan. 25, 2000

[54] METHOD AND ARRANGEMENT FOR ADJUSTING DENSITY IN ELECTROPHOTOGRAPHIC PRINTING

[75] Inventor: Yasutoshi Edura, Tokyo, Japan

[73] Assignee: NEC Corporation, Tokyo, Japan

[21] Appl. No.: 09/288,718

[22] Filed: Apr. 9, 1999

[30] Foreign Application Priority Data

Apr. 10, 1998 [JP] Japan ..... 10-114427

[51] Int. Cl.[7] ..... G03G 15/00; G03G 15/08

[52] U.S. Cl. ..... 399/43; 399/49; 399/60; 399/384

[58] Field of Search ..... 399/15, 27, 30, 399/49, 43, 58, 60, 384; 73/32 R; 324/71.1; 702/137

[56] References Cited

U.S. PATENT DOCUMENTS 5,576,811 11/1996 Kobayashi et al. ..... 399/60

5,905,930 5/1999 Toyama et al. ..... 399/384 X

FOREIGN PATENT DOCUMENTS 62-81648 4/1987 Japan .
3-12669 1/1991 Japan .
6-180534 6/1994 Japan .
10-39607 2/1998 Japan .

*Primary Examiner*—William Royer
*Assistant Examiner*—Sophia S. Chen
*Attorney, Agent, or Firm*—Foley & Lardner

[57] ABSTRACT

A method and arrangement for adjusting density in electrophotographic printing are disclosed. A toner mark is printed at a predetermined location on each of sheets of a continuous stationery. A toner mark sensor is provided to detect density of the toner mark printed on each of the sheets. A controller performs density control based on a result from detecting density of toner mark printed on every other page of the sheets.

6 Claims, 5 Drawing Sheets

METHOD AND ARRANGEMENT FOR ADJUSTING DENSITY IN ELECTROPHOTOGRAPHIC PRINTING

BACKGROUND OF THE INVENTION

1. Field of the Invention

The present invention relates to a method and an arrangement for adjusting density in electrophotographic printing.

2. Description of the Related Art

Electrophotographic printing employs a developing process using a two-component developer, which is a mixture of toner particles and carrier particles. The two-component developer used most frequently is a mixture of toner particles and ferromagnetic carrier particles. Toner concentration (T/C) is a parameter of the developing process. The toner concentration is a mixture ratio between toner particles and carrier particles. Appropriate adjustment of the toner concentration is needed to keep density of electrophotographic image at a constant level.

Adjustment of the toner concentration may be accomplished by controlling toner supply in response to the result from comparing an actual value of sensed density of a toner mark with a reference value. FIG. 5 illustrates a known arrangement for adjusting density in electrophotographic printing. In FIG. 5, a toner mark sensor 31 senses density of a toner mark 36 developed on a recording paper 35 and produces a signal. An analog-to-digital (AD) converter 32 converts the sensor signal into a digital data. A controller 33 inputs the information of an actual value of density of the toner mark 36 from the digital data, compares the actual value of the density with a reference value and produces a toner sensor signal when the actual value is lower than the reference value. A toner supply 34 conducts toner supply in response to the toner sensor signal.

The following disclosures may be relevant to various aspects of the present invention:

JP-A 3-12669 Inventor: Kariya Published: Jan. 21, 1991

JP-A 10-39607 Inventor: Ohki Published: Feb. 13, 1998

JP-A 62-81648 Inventors: Yamada et al. Published: Apr. 15, 1987

JP-A 6-180534 Inventor: Mutou Published: Jun. 28, 1994

The relevant portions of the foregoing disclosures may be briefly summarized as follow:

JP-A 3-12669 discloses a laser printer employing a toner supply control. A toner mark sensor senses an actual value of density of a toner mark on each page or sheet that is defined between the adjacent two perforated creases of a continuous stationery. A toner supply conducts toner supply when the actual density of the toner mark is low. An air nozzle injects air toward the toner mark sensor upon resetting the printing paper.

JP-A 10-39607 discloses a toner supply control. A reference image with a predetermined density is developed on a photoconducive surface of a drum. A light-emitting diode (LED) projects a light onto the developed reference image on the drum. A photoreceptor receives the light reflected by the developed reference image and produces a signal indicative of density of the developed reference image. In response to this signal, fresh toner is fed to a developer. In order to prevent excessive enrichment of developer mixture, the fresh toner supply is interrupted when image forming condition is not complied with.

JP-A 62-81648 discloses a tractor unit for a laser printer. The tractor unit transfers a continuous stationery having perforated creases at regular spacing to define a page or sheet between the adjacent two perforated creases. In order to detect density of a toner mark developed on the continuous stationery outside of image forming area, a toner mark sensor is supported above side edge of the continuous business form by a sensor shifter. The sensor shifter cooperates with the tractor unit.

JP-A 6-180534 discloses a signal processing system for preventing excessive fresh toner supply by reducing a volume of fresh toner supply when a signal produced by a toner sensor exceeds a predetermined level.

In a toner supply control based on a signal of a toner mark sensor, a need remains to keep a distance between a toner mark sensor and a toner mark on each page of a continuous stationery constant. The continuous stationery has a number of perforated creases spaced equidistant along the longitudinal length of the paper to define pages, each between the adjacent two perforated creases. Prior to printing process, the continuous stationery is folded along its perforated creases. A toner mark is printed within an area of each page adjacent a leading one, with respect to a direction of movement of the continuous stationery, of two perforated creases which define the page. Immediately after unfolded along the perforated creases, two adjacent pages of the continuous stationery slope upwardly and downwardly toward their leading perforated creases. This may cause variations in distance between the toner mark sensor and a toner mark on each of the pages of the elongate printing page particularly if the continuous stationery is thick and less flexible.

An object of the present invention is to comply with the before mentioned need without any modification of hardware.

SUMMARY OF THE INVENTION

As far as known to the inventor, the toner marks on one and the subsequent pages of the continuous stationery vary their distances from the toner mark sensor since they slope in different directions toward their leading perforated creases. This causes variations in level of the output signal of the toner mark sensor, making it difficult for the toner supply control to converge.

According to one aspect of the present invention, there is provided a method for adjusting density in printing, the method comprising the steps of:

printing a toner mark at a predetermined location on each of sheets of a stock in a continuous form;

detecting density of the toner mark printed on each of the sheets; and performing density control based on a result from detecting density of toner mark printed on every other page of the sheets.

According to another aspect of the present invention, there is provided an arrangement for adjusting density in electrophotographic printing, comprising:

means for printing a toner mark at a predetermined location on each of sheets of a stock in a continuous form;

a toner mark sensor to detect density of the toner mark printed on each of the sheets; and a controller to perform density control based on a result from detecting density of toner mark printed on every other page of the sheets.

DESCRIPTION OF THE PREFERRED EMBODIMENT

Figure 1:
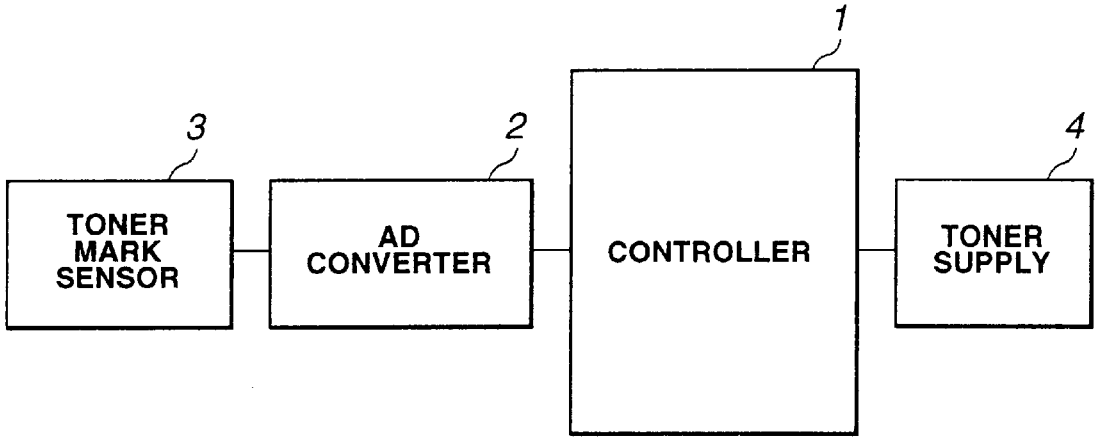
FIG. 1 is a simplified block diagram of the preferred implementation of the present invention.

Referring to FIG. 1, an arrangement for adjusting density in electrophotographic printing comprises a controller 1, an analog-to-digital (AD) converter 2, a toner mark sensor 3 and a toner supply 4. The controller 1 includes a central processor unit (CPU) and a memory preferably in the form of a read only memory (ROM). The memory stores programs that will be briefly explained later along the flow charts of FIGS. 2 and 3.

Figure 4:
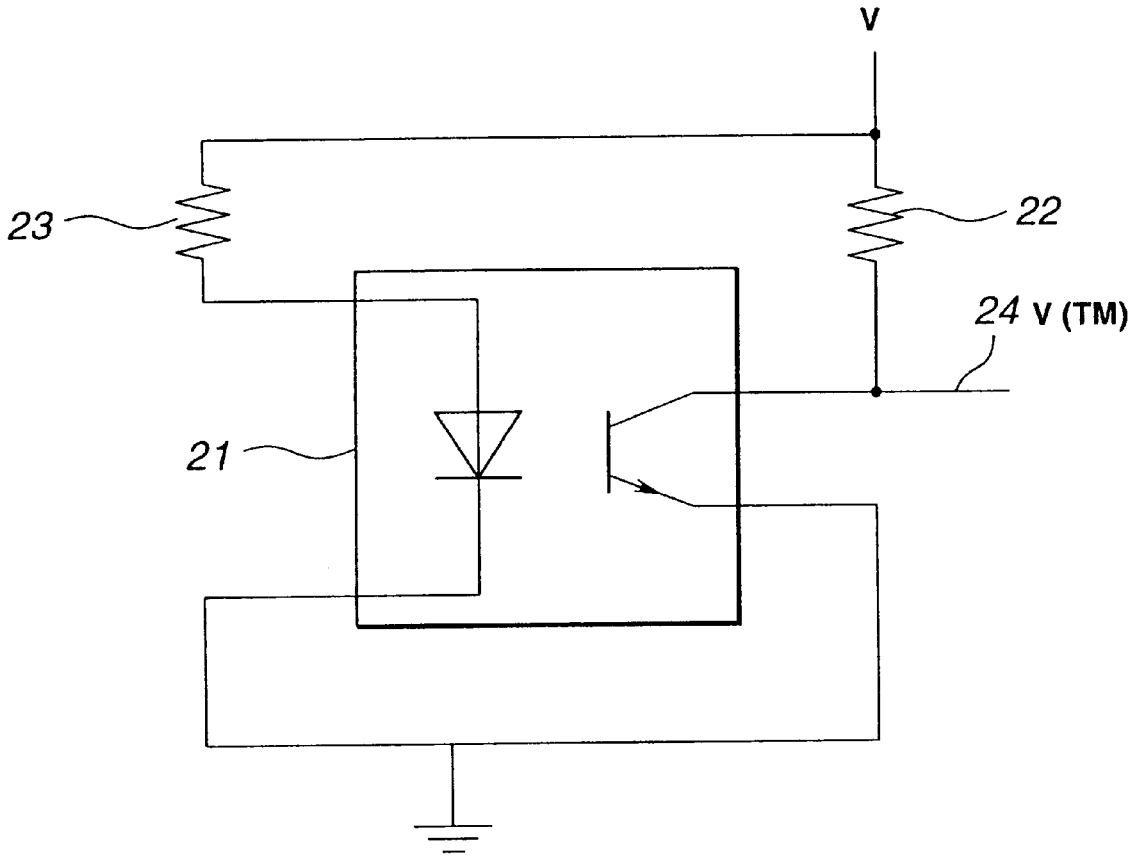
FIG. 4 is a circuit diagram of a portion of a toner mark sensor.
Figure 5:
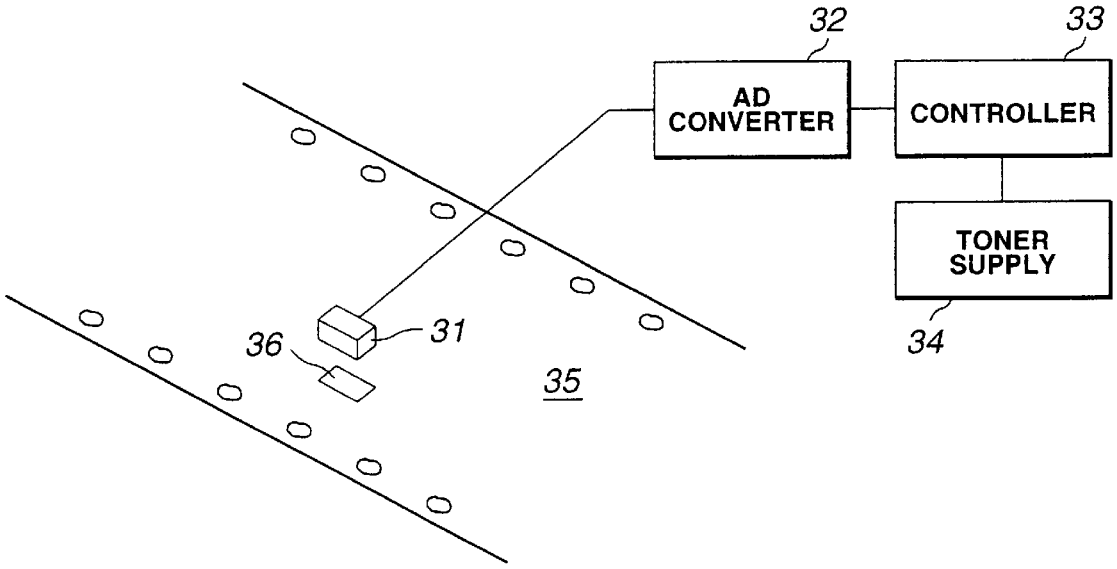
FIG.5 PRIOR ART
FIG. 5 is a simplified block diagram of the before discussed prior control arrangement.

The toner mark sensor 3 includes a light-emitting diode as a source of light to be projected onto the continuous stationery. It also includes a photodiode 21 (see FIG. 4) in which current flow is regulated by light intensity of the reflected light by the toner mark. Variation in density of toner mark causes variation in the light intensity of the reflected light, thus causing variation in current flow through the photodiode 21. In FIG. 4, resistors 22 and 23 are circuited with the photodiode 21 to produce at an output terminal 24 an output voltage V(TM) indicative of the detected density of toner mark. The toner mark having a predetermined pattern is printed on every pages or sheets of a stock in a continuous form. In the preferred implementation, the stock is a continuous stationery having perforated creases between sheets or pages.

Figure 2:
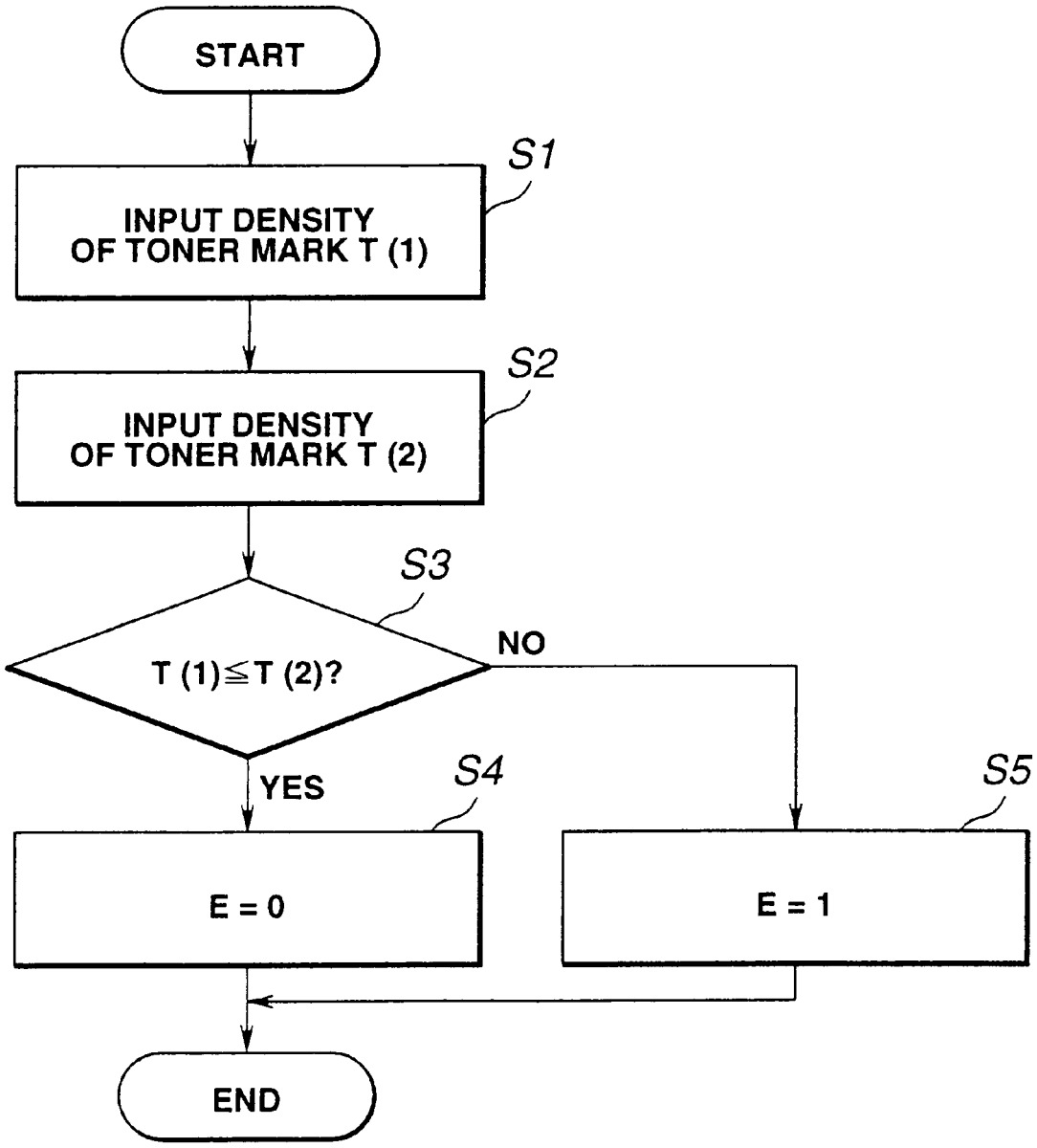
FIG. 2 is a flow chart illustrating a control routine of the preferred implementation of the present invention.

The flow chart of FIG. 2 illustrates a control routine to be executed once upon start-up operation of electrophotographic printing.

In step S1, the CPU inputs information of density of toner mark on one page by reading operation of signal of the toner mark sensor 3 and stores the result as T(1). In the next step S2, the CPU inputs information of density of toner mark on the next subsequent page by reading operation of signal of the toner mark sensor 3 and stores the result as T(2).

In interrogation step S3, the CPU determines whether or not T(1) is less than or equal to T(2). If this is the case (YES), the CPU resets a processing flag E(E=0) in step S4. If, in step S3, it is determined that T(1) is greater than T(2), the CPU sets the processing flag E(E=1) in step S5. The processing flag E is referred to in the control routine of FIG. 3.

Figure 3:
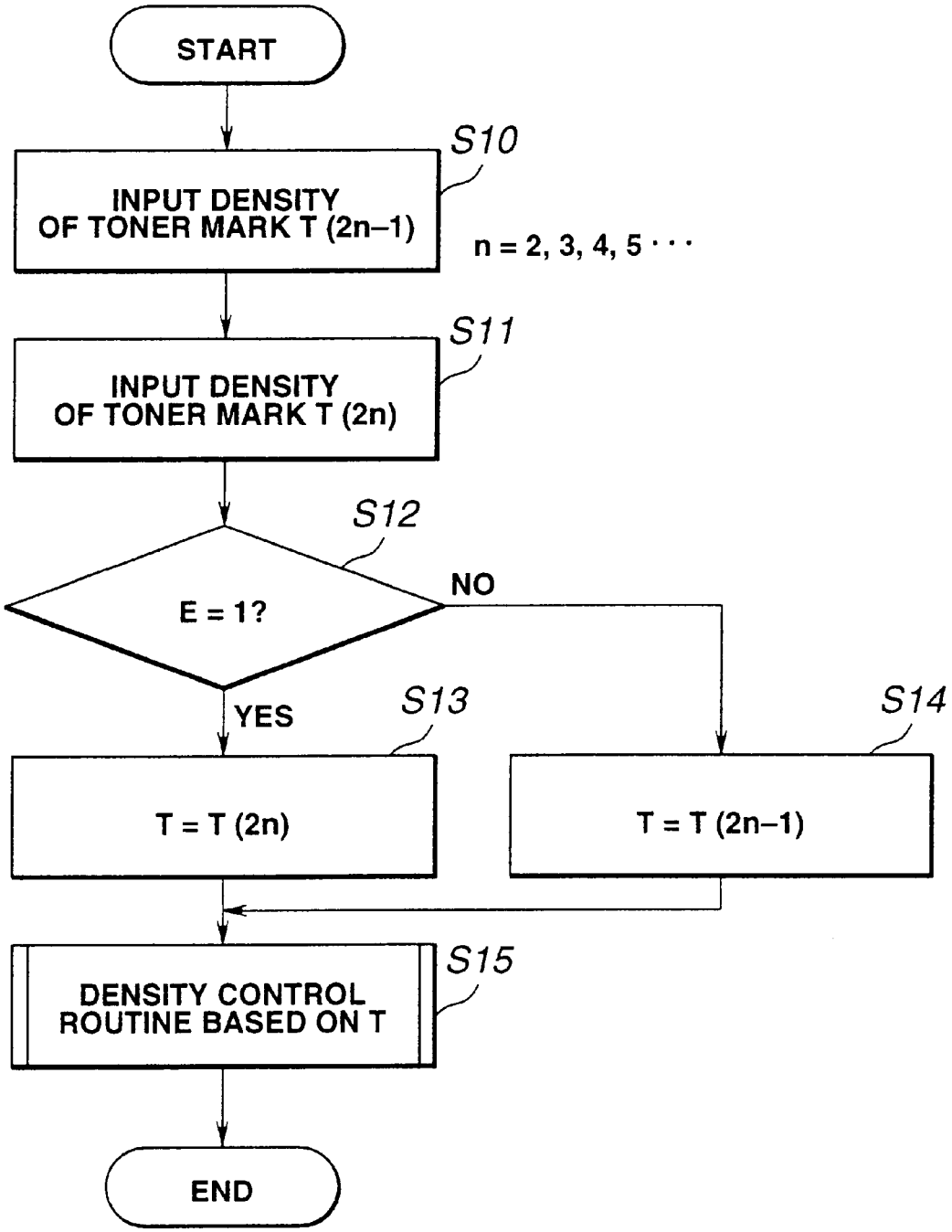
FIG. 3 is a flow chart illustrating a control routine of the preferred implementation of the present invention.

The flow chart of FIG. 3 illustrates the control routine, execution of which is repeated after the control routine of FIG. 2 during continuous printing.

In step S10, the CPU inputs information of density of toner mark on 2n−1 (odd) page by reading operation of signal of the toner mart sensor 3 and stores the result as T(2n−1), where: n is a positive counter number excluding zero and one. In the next step S11, the CPU inputs information of density of toner mark on the next subsequent 2n (even) page by reading operation of signal of the toner mark sensor 3 and stores the result as T(2n).

In interrogation step S12, the CPU determines whether or not the processing flag E is set. If this is the case, the routine proceeds to step S13. If this is not the case, the routine proceeds to step S14. In step S13, the CPU sets a parameter T equal to T(2n). In step S14, the CPU sets the parameter T equal to T(2n−1).

In step S15, the CPU performs a density control routine based on the parameter T.

In electrophotographic printing using a continuous stationery, a perforated crease peak or a perforated crease valley passes alternately under the toner mark sensor 3. The magnitude of output signal of the toner mark sensor 3 shifts to a high level upon passage of the perforated crease peak and to a low level upon passage of the perforated crease valley. The shift of the signal to the high level results from a reduction in distance between the toner mark sensor 3 and the continuous stationery due to elevation of the perforated crease peak. Thus, this high-level signal cannot be regarded as an indication of the detected density of toner mark.

Therefore, according to the preferred implementation, the processing flag E is set or reset for using a lower one of the two subsequent occurrences of the output signal of the toner mark sensor 3 as the parameter T. This parameter T is used in the density control routine in adjusting toner supply.

The above-described implementation of the present invention is an example implementation. Moreover various modifications to the present invention may occur to those skilled in the art and will fall within the scope of the present invention as set forth below.

What is claimed is:

1. A method for adjusting density in printing, the method comprising the steps of:

printing a toner mark at a predetermined location on each of sheets of a stock in a continuous form;

detecting density of the toner mark printed on each of the sheets; and performing density control based on a result from detecting density of toner mark printed on every other page of the sheets.

2. The method as claimed in claim 1, wherein the stock is a continuous stationery.

3. The method as claimed in claim 2, wherein the continuous stationery has perforated creases between the sheets, and wherein the predetermined location is adjacent the perforated crease.

4. An arrangement for adjusting density in electrophotographic printing, comprising:

means for printing a toner mark at a predetermined location on each of sheets of a stock in a continuous form;

a toner mark sensor to detect density of the toner mark printed on each of the sheets; and a controller to perform density control based on a result from detecting density of toner mark printed on every other page of the sheets.

5. The arrangement as claimed in claim 4, wherein the stock is a continuous stationery.

6. The arrangement as claimed in claim 4, wherein the continuous stationery has perforated creases between the sheets, and wherein the predetermined location is adjacent the perforated crease.

* * * * *